US011369204B2

(12) United States Patent
Bock

(10) Patent No.: US 11,369,204 B2
(45) Date of Patent: Jun. 28, 2022

(54) ARMREST, IN PARTICULAR FOR AN OFFICE CHAIR

(71) Applicant: BOCK 1 GMBH & CO. KG, Postbauer-Heng (DE)

(72) Inventor: Hermann Bock, Pyrbaum (DE)

(73) Assignee: BOCK 1 GmbH & Co. KG, Postbauer-Heng (DE)

( * ) Notice: Subject to any disclaimer, the term of this patent is extended or adjusted under 35 U.S.C. 154(b) by 0 days.

(21) Appl. No.: 17/154,084

(22) Filed: Jan. 21, 2021

(65) Prior Publication Data

US 2021/0219729 A1 Jul. 22, 2021

(30) Foreign Application Priority Data

Jan. 21, 2020 (DE) ..... 102020101309.4

(51) Int. Cl.
*A47C 7/54* (2006.01)

(52) U.S. Cl.
CPC ..... *A47C 7/541* (2018.08)

(58) Field of Classification Search
CPC ..... A47C 7/54
USPC ..... 297/411.31, 411.37
See application file for complete search history.

(56) References Cited

U.S. PATENT DOCUMENTS 6,106,070 A * 8/2000 Ritt ..... A47C 1/0303 297/411.35
6,948,774 B2 9/2005 Maier et al.
7,188,907 B1 * 3/2007 Lai ..... A47C 1/03 297/411.35
7,387,341 B1 * 6/2008 Tsai ..... A47C 1/03 297/411.35
2004/0130200 A1 * 7/2004 Willette ..... A47C 1/03 297/411.37
2005/0146192 A1 * 7/2005 Trego ..... A47C 1/03 297/411.37
2005/0184574 A1 * 8/2005 Tsai ..... A47C 1/03 297/411.37
2009/0033139 A1 * 2/2009 Machael ..... A47C 1/0307 297/411.37
2011/0254340 A1 * 10/2011 Hsuan-Chin ..... A47C 1/0308 297/411.31
2012/0025584 A1 * 2/2012 Chen ..... A47C 1/0307 297/411.37
2021/0037981 A1 * 2/2021 Serena ..... A47C 1/0303

FOREIGN PATENT DOCUMENTS

DE 102020204848 A1 * 4/2021 ..... A47C 1/0307
EP 1405582 A1 4/2004

* cited by examiner

*Primary Examiner* — Rodney B White
(74) *Attorney, Agent, or Firm* — Laurence A. Greenberg; Werner H. Stemer; Ralph E. Locher

(57) ABSTRACT

An office chair has an armrest. In order to provide an armrest which is of particularly simple construction, the armrest contains an armrest column and an arm support which is mounted on the armrest column and is rotatable about a rotation axis and which is linearly displaceable relative to the armrest column. A rotary mechanism for the rotation of the arm support is arranged substantially fully within the armrest column.

10 Claims, 6 Drawing Sheets

ARMREST, IN PARTICULAR FOR AN OFFICE CHAIR

CROSS-REFERENCE TO RELATED APPLICATION

This application claims the priority, under 35 U.S.C. § 119, of German patent application DE 10 2020 101 309.4, filed Jan. 21, 2020; the prior application is herewith incorporated by reference in its entirety.

BACKGROUND OF THE INVENTION

Field of the Invention

The invention relates to an armrest, in particular for an office chair.

From the prior art, adjustable armrests are known. They often have a rotary and longitudinal adjustment mechanism. Armrests having a plurality of setting options are here mostly of complicated construction and have very many mutually interacting structural elements.

BRIEF SUMMARY OF THE INVENTION

An object of the present invention is to provide an armrest which is of particularly simple construction in terms of its design.

This object is achieved by an armrest according to the independent claim. Advantageous embodiments of the invention are defined in the subclaims.

The armrest according to the invention contains an armrest column and an arm support which is mounted on the armrest column and is rotatable about a rotation axis and which is linearly displaceable relative to the armrest column, wherein the rotary mechanism for the rotation of the arm support is arranged substantially fully within the armrest column.

A basic idea of the invention is to arrange the rotary mechanism, at least almost fully or substantially, inside the armrest column. This means that the rotary mechanism is located inside a structural element of the armrest, which structural element is optionally movable in height, i.e. in the vertical, though not in the horizontal, to be precise neither in the form of a linear movement nor in the form of a rotary movement. To put it another way, the rotary mechanism is located specifically not inside a sub-assembly of the armrest, which sub-assembly is mounted on the armrest column and performs a movement in the horizontal, such as the arm support. Instead, the rotary mechanism, with the aid of which a rotation of the arm support is enabled, is placed separate from the arm support, namely in the armrest column.

In this way, not only is the design structure of the armrest simplified. At the same time, also the process of assembling the armrest is simplified, since the rotary mechanism has merely to be fitted into the generally widened opening of the armrest column. A complicated installation of small parts into the inside of the arm support is not necessary.

With the present invention, it is thus not only possible to construct the arm support particularly simply in design terms. The arm support can also be configured particularly flat. This low required structural height provides a large number of advantageous design options.

In relation to the previously known adjustable armrests, in which, due to the use of just one single central guide element for the longitudinal adjustment, particularly high requirements have been placed upon the mechanical load-bearing capacity of this guide element and its supporting, holding and guide components, the invention allows cheaper materials to be used, in particular when two simultaneously acting guide or force transmission elements are used, since the forces which act on these elements and are transmitted by the user via the arm support to the armrest column are halved. Ultimately, also the guide slot on the bottom side of the arm support, which guide slot forms the functional opening for the longitudinal adjustment of the arm support, can also be made significantly narrower than the solutions known from the prior art. Advantageously, the width of the guide slot is less than 7 mm, so that, from safety aspects, it no longer constitutes a shearing or pinching point for the finger of the user of the chair. Nor does the guide slot then any longer have to be elaborately closed off or secured against nipping, for instance by means of a closure cap that is jointly transported in accordance with the longitudinal displacement, so that the design complexity of the armrest is further reduced.

Other features which are considered as characteristic for the invention are set forth in the appended claims.

Although the invention is illustrated and described herein as embodied in an armrest, in particular for an office chair, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
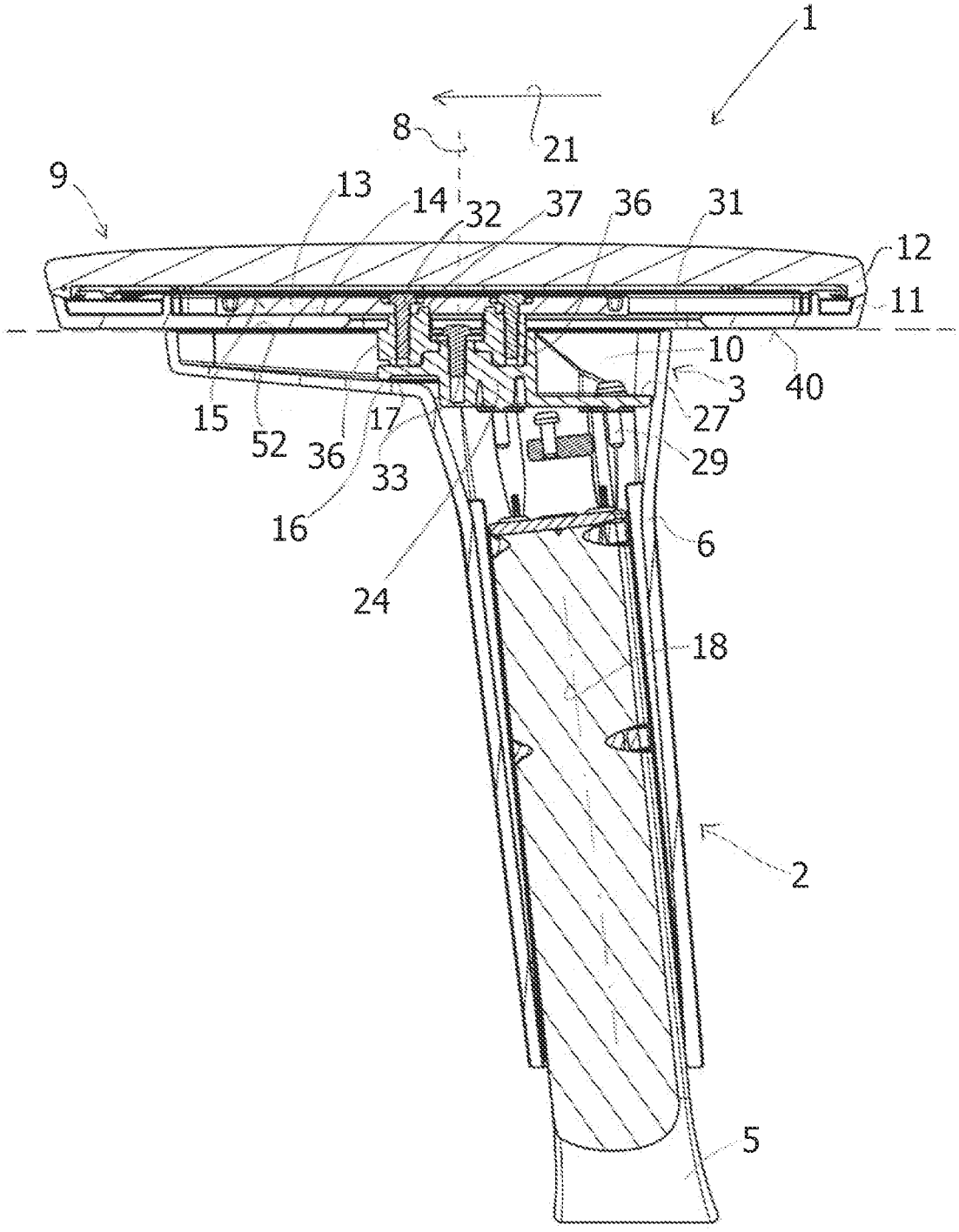
FIG. 1 is a diagrammatic, longitudinal sectional view of an armrest.
Figure 2:
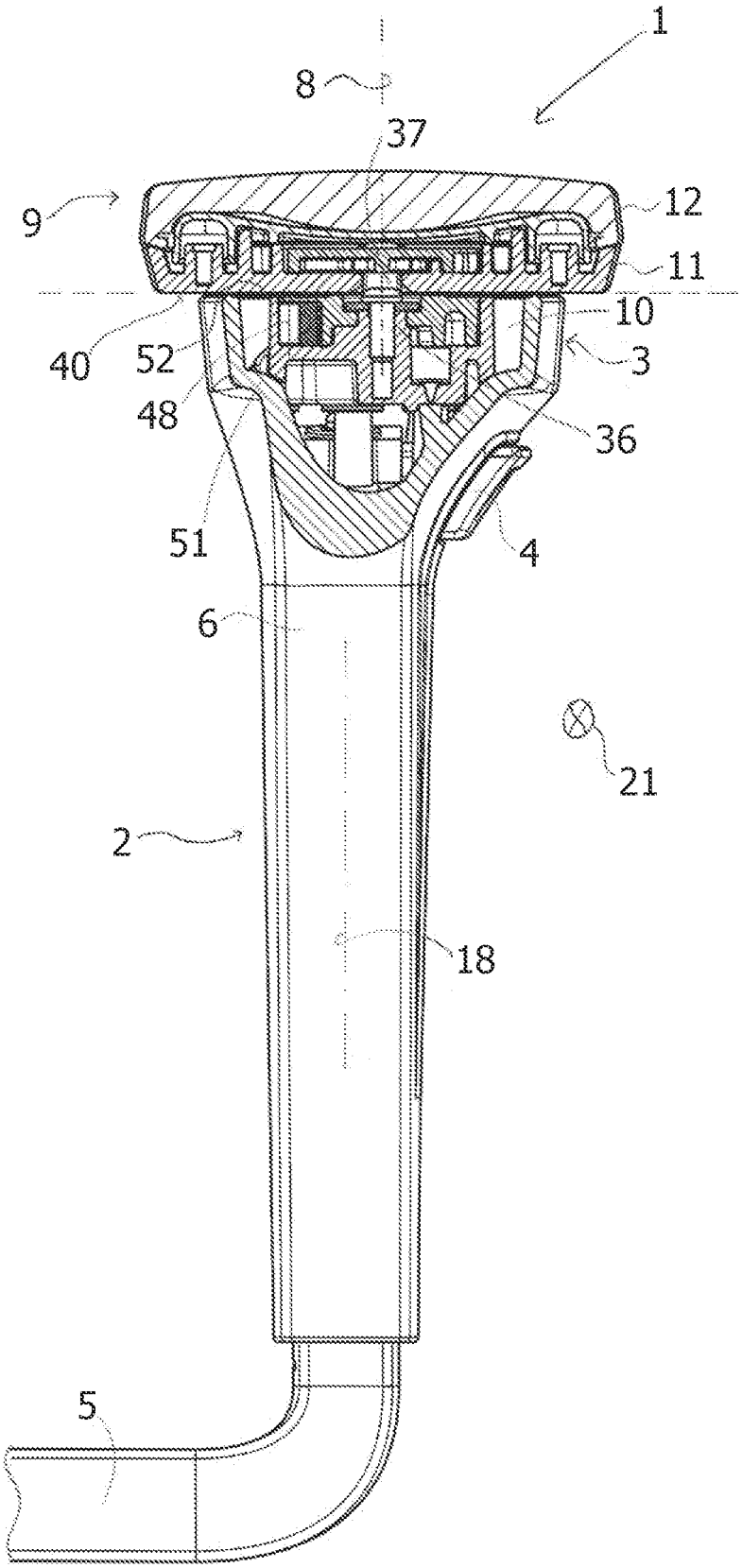
FIG. 2 is a cross-sectional view of the armrest.
Figure 3:
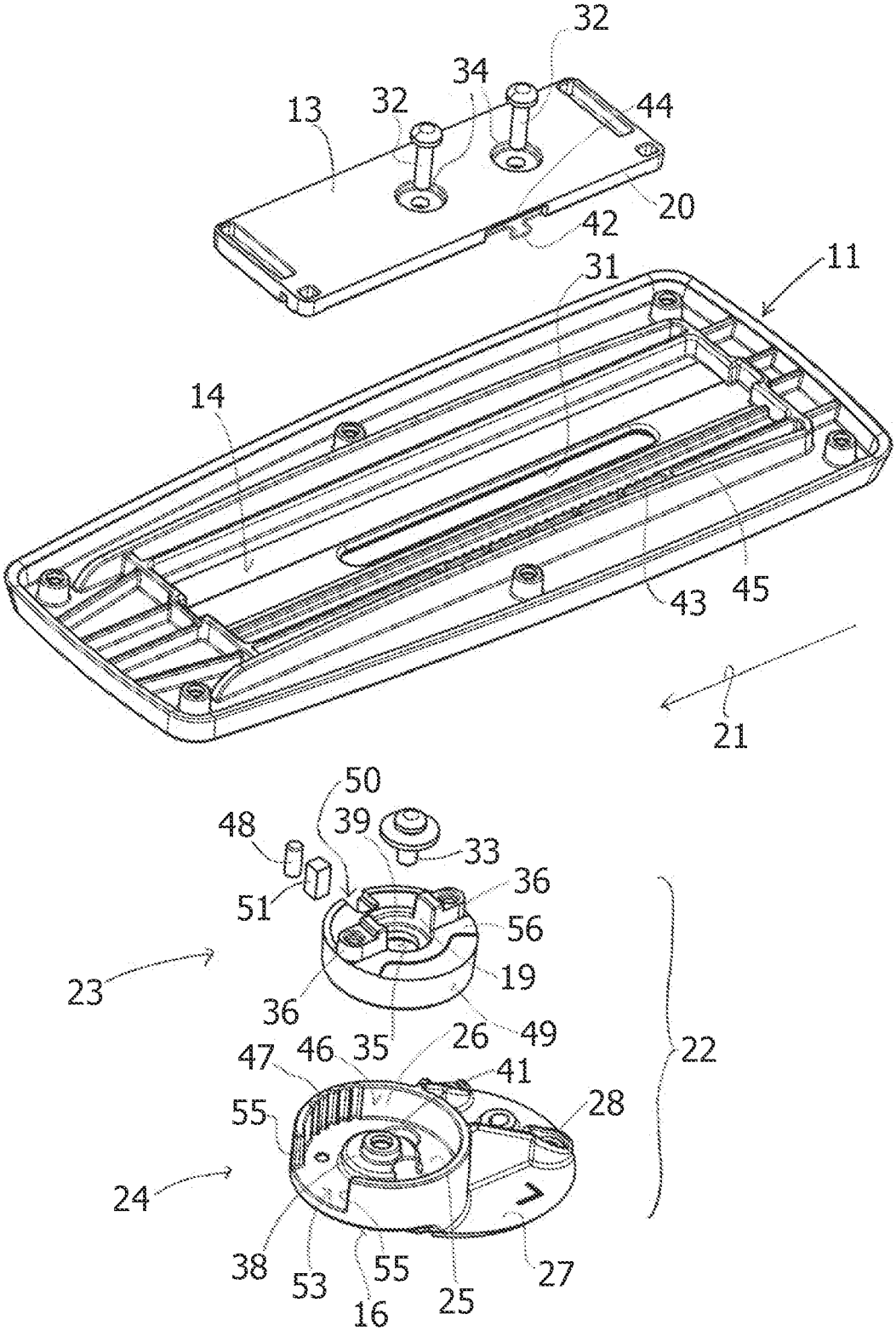
FIG. 3 is an exploded, perspective view of parts of an arm support and of a rotary mechanism.
Figure 4:
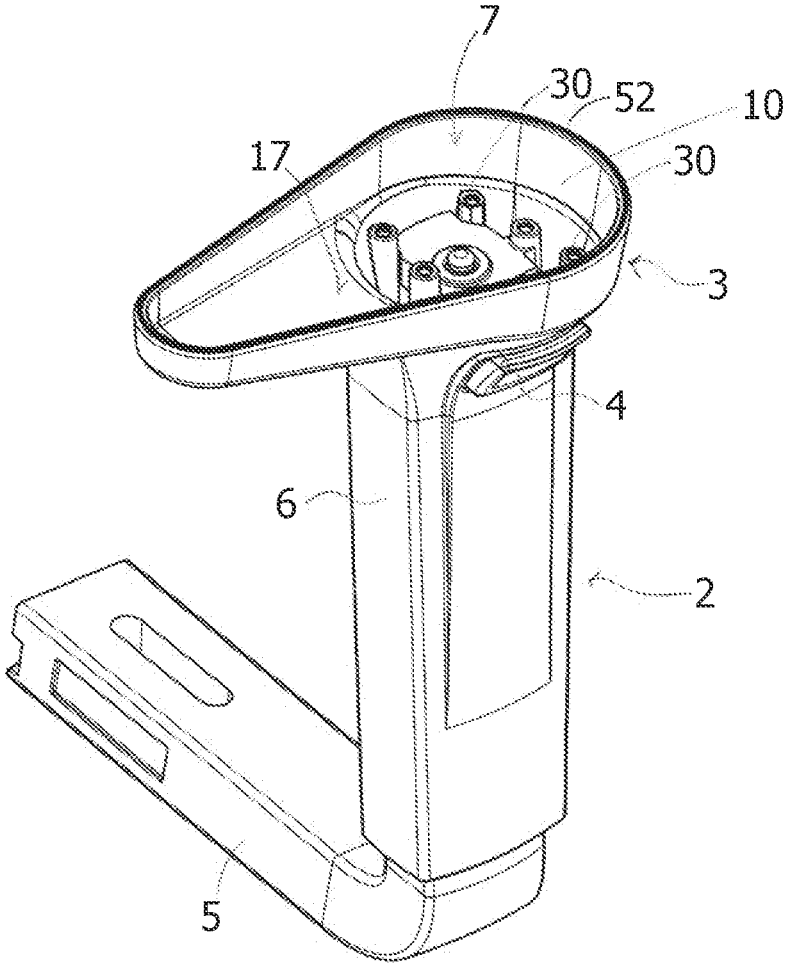
FIG. 4 is a perspective view of the armrest sleeve without the rotary mechanism.
Figure 5:
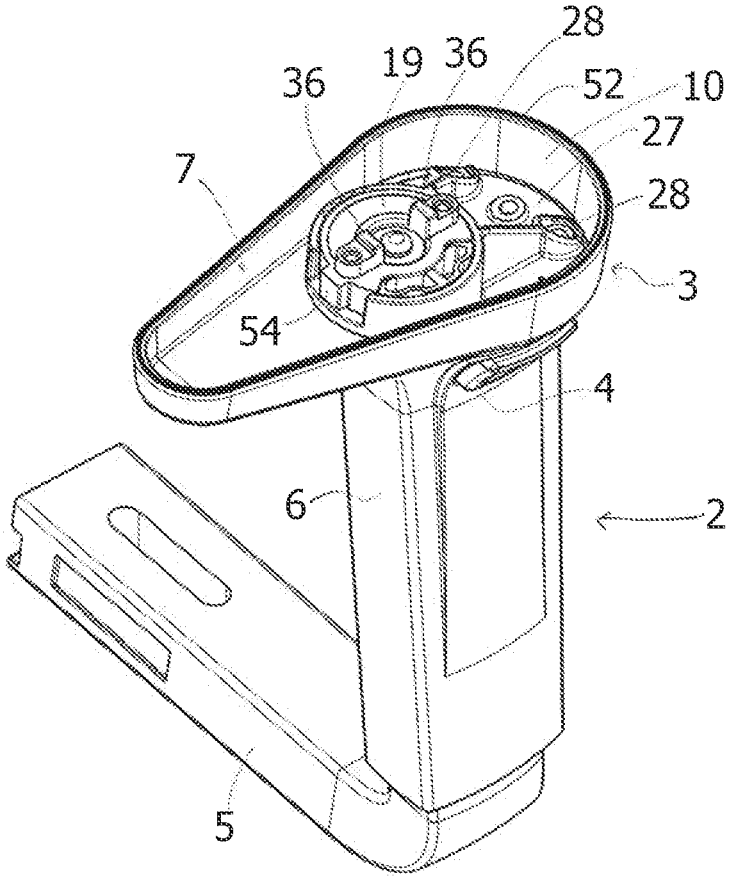
FIG. 5 is a perspective view of the armrest sleeve with the rotary mechanism.
Figure 6:
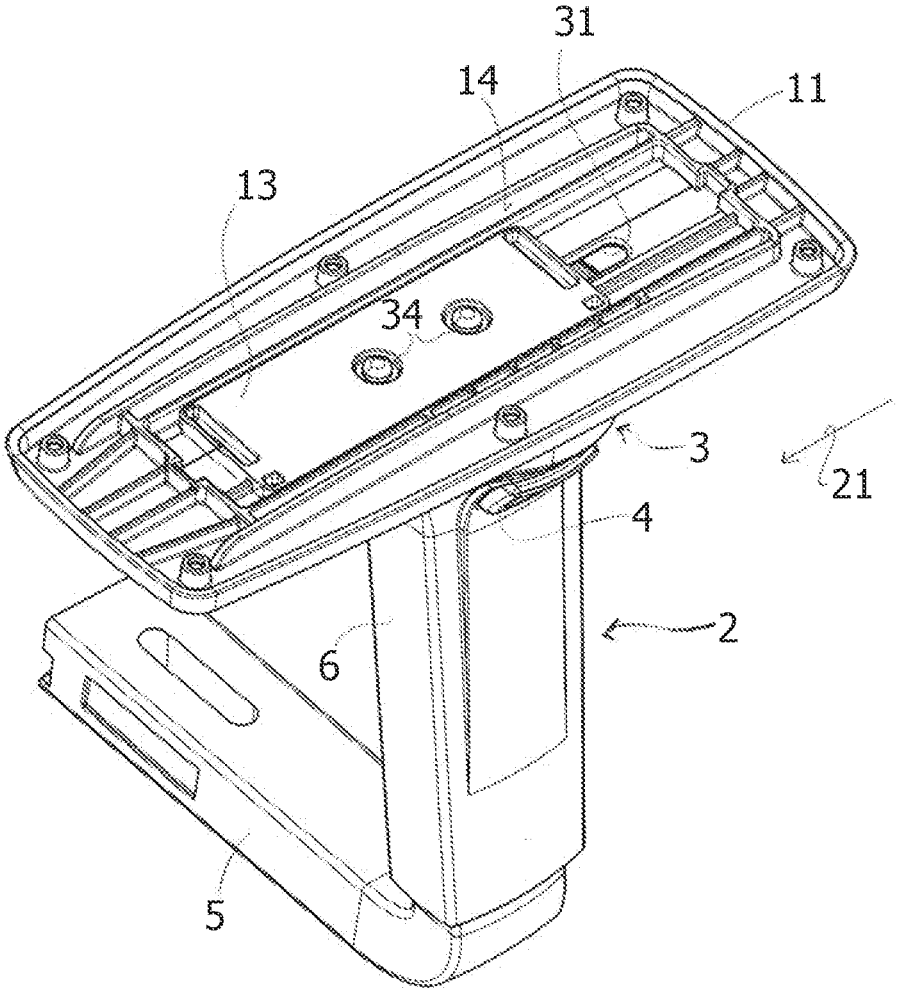
FIG. 6 is a perspective view of the armrest without a support body.

All figures show the invention in non-true-to-scale representation, here merely schematically and only with their basic components. Same reference symbols here correspond to elements of same or comparable function. FIGS. 3 and 4, in combination, show an exploded representation of the armrest represented in FIG. 6, without a support body.

Referring now to the figures of the drawings in detail and first, particularly to FIGS. 1-5 thereof, there is shown an armrest 1 that has a height-adjustable, in particular telescopically constructed armrest column 2, an outer sleeve 6 of which, at its upper end, is widened in relation to the actual column part and in this way forms a bearing head 3 for an arm support 9. The outer sleeve 6 of the armrest column 2, which outer sleeve is upwardly opened, yet anyway possesses a sufficiently large opening 7, is closed by the arm support 9 in the manner of a cap. As described in greater detail further below, the arm support 9 can be rotated relative to the armrest column 2 about a vertical rotation axis 8 and linearly displaced in relation to the armrest column 2 in the arm support longitudinal direction 21. During both movements, the arm support 9 here rests on a rim 52 of the opening 7 of the armrest column 2. Hence the opening rim 52 and a bottom side 40 of the arm support 9 at the same time delimit an interior 10 of the armrest column 2 in the upward direction.

For the height adjustment of the armrest 1 is provided an actuating button 4, which juts through an aperture of the armrest column 2, the aperture being open toward the outer side. The armrest column 2 can be fastened to the substructure of the office chair (not depicted) with the aid of an armrest support 5 which leads out horizontally at the lower foot end of said armrest column. The specifications "at the rear/front" or "at the top/bottom" and "perpendicularly/horizontally", etc. respectively relate to the normal usage state of the office chair.

The arm support 9 contains a mount 11 and a support body 12 detachably connected to the mount 11. The mount 11 and the support body 12 can here be connected to one another, for instance, with the formation of a screwing, latching, snap-locking or clamping connection. In the mount 11 of the arm support 9 is provided a guide slot 31 running in the arm support longitudinal direction 21. This serves to provide a sliding block guide for the linear displacement of the arm support 9 relative to the armrest support 2.

Between the mount 11 and the support body 12 is arranged, as a transmission or driver or coupling element, a holding plate 13. In the mounted state, the holding plate 13 bears both against the top side 14 of the mount 11 and against the bottom side 15 of the support body 12 and is connected to the mount 11 and/or the support body 12 such that it forms with these two components a motion unit.

The length of the holding plate 13 (viewed in the arm support longitudinal direction 21) is here greater than the length of the guide slot 31, so that the holding plate 13 at least partially covers the guide slot 31 in all positions of these two components relative to one another.

Provided centrally in the holding plate 13, spaced apart in the longitudinal direction 21, are two openings 34 for receiving locking screws 32, which, for the connection of the arm support 9 to the armrest column 2, connect the holding plate 13 to two sliding blocks 36, which, with their necks 37, jut through the guide slot 31. In other words, the necks 37 lie as guide elements in the guide slot 31.

The sliding blocks 36, which serve as guide or force transmission elements of the arm support 9 and are configured in the form of guide pins are parts of a rotary piece 23 of a rotary bearing 22 which is arranged in the armrest column 2 and provides the rotary mechanism necessary for the rotation of the arm support 9. Besides the rotary piece 23, the rotary bearing 22 contains means for supporting the rotary piece 23.

In the illustrated example, the circular-cylindrical rotary piece 23 lies in an appropriately dimensioned bearing bush 24 configured to support and guide the rotary piece 23. The bearing bush 24 is realized in the shape of a pot with base 25 and wall 26.

Provided centrally in the base 25 of the bearing bush 24 is a plain bearing 38, which is raised in the manner of a mandrel and which interacts with a plain bearing 39 that is provided on the rotary piece 23, likewise centrally there. In addition, the location of the rotary piece 23 in the bearing bush 24 is secured with the aid of a locking screw 33. For this purpose, the rotary piece 23 is centrally provided with an opening 35, through which the locking screw 33 is guided and can be screwed into a threaded opening 41 appropriately provided in the center of the plain bearing 38 of the bearing bush 24.

For ergonomic reasons, that site of the rotation axis 8 that is defined by the bearings 38, 39 is arranged, with a view to the use of the armrest 1, offset from the central longitudinal axis 18 of the armrest column 2, which, in the example here shown, runs obliquely to the vertical.

The bearing bush 24 or another suitable means for supporting the rotary piece 23 can be configured as an integral part of the armrest column 2. Thus, the bearing bush 24 can be injection molded, for instance, onto the armrest column 2, or integrally connected to the armrest column 2 in some other way. The bearing bush 24 or another suitable bearing means can also however be realized, as in the illustrated example, as a separate component. In this case, the bearing bush 24 must be connected sufficiently fixedly to the armrest column 2. In the represented example, the bearing bush 24 is for this purpose provided with a mounting plate 27, which on one side adjoins the bearing bush 24 and extends the base 25 of the bearing bush 24 to one side. The mounting plate 27 has openings 28 for mounting screws 29, with which the rotary bearing 22 is connected to appropriately configured connecting points 30 of the armrest column 2.

In the mounted state, the bearing bush 24 rests with its bottom side 16, on the side lying opposite the mounting plate 27, on a supporting portion 17 of the armrest column 2, which supporting portion is provided by the widening of the outer sleeve 6. A particularly stable mounting of the rotary bearing 22 in the armrest column 2 is thereby achieved.

The mandrel-like sliding blocks 36 are configured, together with the middle part 19 which forms the plain bearing 39 and at the same time also has the opening 35, in one piece. This middle part 19 lies in a designated receptacle of the main body 56 of the rotary piece 23. The sliding blocks 36 jut vertically upward out of this main body 56 into the end opening 7 of the outer sleeve 6.

With their ends, the sliding blocks 36 jut beyond the rim 52 of the opening 7 of the armrest column 2 into the arm support 9, so that an actually complete arrangement of the rotary mechanism in the interior 10 of the armrest column 2 cannot be asserted. Correctly speaking, the rotary mechanism is therefore accommodated merely "substantially fully" in the armrest column 2.

Since the bearing bush 24 is fixedly connected to the armrest column 2, a linear displacement of the arm support 9 in the arm support longitudinal direction 21 is possible, in that the arm support 9 connected to the rotary bearing 22 via the holding plate 13 and the sliding blocks 36 is moved relative to the armrest column 2 in the arm support longitudinal direction 21.

Independently of such a linear movement of the arm support 9, a rotation of the arm support 9 about the vertical rotation axis 8, defined by the rotary bearing 22, of the armrest 1 is possible, in that the arm support 9, when subjected to a force that is not acting in the arm support longitudinal direction 21, is moved relative to the armrest column 2. Both the linear movement and rotary movement of the arm support 9 can be performed independently of one another, including simultaneously.

The rim 52 of the opening 7 defines a horizontal separating plane (indicated in FIGS. 1 and 2 with a broken line), which separates an upper armrest sub-assembly, containing the arm support 9, and a lower armrest sub-assembly, containing the armrest column 2, from one another. The rotary mechanism, in this case, therefore, the rotary bearing 22 with bearing bush 24 and rotary piece 23, is part of the lower armrest sub-assembly, while the upper armrest sub-assembly can be rotated relative to the lower armrest sub-assembly by the rotary mechanism.

The rotary mechanism is a part of a sub-assembly distinguished by the fact that neither this sub-assembly as a whole, nor parts of this sub-assembly, can perform lateral movements within a horizontal spatial plane; this sub-assembly as a whole can neither perform a linear movement nor a rotary movement.

In a particularly preferred embodiment of the invention, both the linear movement and the rotary movement of the arm support 9 are controllable with suitable positioning or operating means.

Thus, in respect of the longitudinal adjustment of the arm support 9, it is preferably provided that the mounting plate 13 possesses a latching boss 42, which in the assembled state, engaging in latching recesses 43 provided on the mount 11, preferably forms a thrust ratchet with frictional engagement. The latching boss 42 here serves as a latching catch and the latching recesses 43 serve as latching grooves, which define a number of latching positions arranged in the longitudinal direction 21 of the arm support 9. In the resulting bilaterally force-locking ratchet mechanism, in the latching positions there is merely generated an increased resistance to the movement, which resistance can be surmounted by an appropriately increased force. When a movement is made with uniform force, the arm support 9 therefore, in the relevant positions, finds rest positions or latching positions.

The preferably self-springing latching boss 42, which is formed, in particular, by a spring element and is made, for instance, of spring steel, is here integrated in one of the longitudinal edges 20 of the holding plate 13, which, for this purpose, has a receiving opening 44 suitable for receiving the spring element. In the assembled state, the latching boss 42 juts out of the holding plate 13 transversely to the arm support longitudinal direction 21. The latching recesses 43 are arranged directly adjacent to one another level with the guide slot 31 on the top side 14 of the mount 11, to be precise in the form of a bar 45 lying parallel to the guide slot 31, in the here represented example as an integral part of a strut arrangement on the mount top side 14. In a varying embodiment, the latching boss 42 can also be configured in one piece with the holding plate 13.

In respect of the rotary adjustment of the arm support 9, it is preferably provided to equip the inner side 46 of the wall 26 of the bearing bush 24 with appropriate latching recesses 47 along a wall segment corresponding to the provided angle of rotation, and to attach to the rotary piece 23 a latching element 48 which, in the assembled state, engaging in the latching recesses 47, forms a ratchet, preferably a thrust ratchet, with frictional engagement, such as has also been described in respect of the longitudinal adjustment. The latching element 48 is in this case constituted by a spring-loaded latching cylinder made of a non-resilient material, which latching cylinder, in a receiving pocket 50 configured on the outer side 49 of the rotary piece 23, lies in the rotary piece 22. The latching element 48 is pressed against the latching recesses 47 with the aid of spring element 51, likewise lying in the receiving pocket 50. Instead of such a combination of latching element 48 and spring element 51, a self-springing latching element can also be provided for the latching device of the rotary adjustment.

In both latching devices, the number of latching steps can also be chosen in accordance with the adjustment travel. By a suitable material selection, the resistance which has to be surmounted in the course of the adjustment, and hence the strength of the haptic feedback, as well as, where desired, also the loudness of an acoustic feedback, can be set.

The maximum angle of rotation of the rotary piece 23 is defined by stops. For this purpose, in the wall 26 of the bearing bush 25 is provided a recess 53, into which a radially outwardly projecting movement limiter 54 on the main body 56 of the rotary piece 23 juts. When the maximum possible rotation is reached, the limiter 54 butts against the vertical rims 55 of the recess 53.

All features represented in the description, the following claims and the drawing can be fundamental to the invention, both in isolation and in any chosen combination.

REFERENCE SYMBOL LIST

1 armrest
2 armrest column
3 bearing head
4 actuating button
5 armrest support
6 outer sleeve
7 opening
8 rotation axis
9 arm support
10 interior
11 mount
12 support body
13 holding plate
14 top side of the mount
15 bottom side of the support body
16 bottom side of the bearing bush
17 supporting portion
18 central longitudinal axis
19 middle part of the rotary piece
20 longitudinal edge
21 arm support longitudinal direction
22 rotary bearing
23 rotary piece
24 bearing bush
25 base
26 wall
27 mounting plate
28 opening
29 mounting screw
30 connecting point
31 guide slot
32 locking screw
33 locking screw
34 opening
35 opening
36 sliding block
37 neck
38 plain bearing
39 plain bearing
40 bottom side of the arm support
41 threaded opening
42 latching boss
43 latching recess
44 receptacle
45 bar
46 wall inner side
47 latching recess
48 latching element

49 outer side of the rotary piece
50 receiving pocket
51 spring element
52 opening rim
53 recess
54 limiter
55 stop rim
56 main body

The invention claimed is:

1. An armrest, comprising:

an armrest column;

an arm support mounted on said armrest column and being rotatable about a rotation axis and being linearly displaceable relative to said armrest column; and a rotary mechanism for rotating said arm support and disposed substantially fully within said armrest column;

a sliding block guide, said arm support being connected to said armrest support in a linearly displaceable manner with an aid of said sliding block guide;

said arm support having a bottom side with a guide slot formed therein; and a number of said guide elements of said sliding block guide reach through said guide slot provided on said bottom side of said arm support.

2. The armrest according to claim 1, wherein said rotary mechanism for rotating said arm support is disposed fully within an interior of said armrest column, and said interior is closed by said arm support in a manner of a cap.

3. The armrest according to claim 1, wherein said arm support has a mount and a support body, said support body is connected to said mount;

wherein said mount has a guide slot formed therein, said guide slot runs in an arm support longitudinal direction; and further comprising a holding plate disposed between said mount and said support body, said holding plate forming a motion unit with said mount and/or with said support body.

4. The armrest according to claim 3, said support body is connected detachably to said mount.

5. The armrest according to claim 3, wherein said holding plate at least partially covers said guide slot.

6. The armrest according to claim 1, wherein:

said armrest column has a rim with an opening formed therein; and said arm support rests on said rim of said opening of said armrest column.

7. The armrest according to claim 1, wherein said sliding block guide has at least two simultaneously acting guide elements.

8. The armrest according to claim 7, wherein said rotary mechanism has a rotary bearing with a rotary piece, and a number of said guide elements of said sliding block guide are fastened to said rotary piece of said rotary bearing.

9. The armrest according to claim 1, wherein the armrest is for an office chair.

10. A chair, comprising:

an armrest having an armrest column, an arm support mounted on said armrest column and being rotatable about a rotation axis and being linearly displaceable relative to said armrest column, and a rotary mechanism for rotating said arm support and disposed substantially fully within said armrest column;

a sliding block guide, said arm support being connected to said armrest support in a linearly displaceable manner with an aid of said sliding block guide;

said arm support having a bottom side with a guide slot formed therein; and a number of said guide elements of said sliding block guide reach through said guide slot provided on said bottom side of said arm support.

* * * * *